US006289534B1

(12) United States Patent
Hakamiun et al.

(10) Patent No.: US 6,289,534 B1
(45) Date of Patent: Sep. 18, 2001

(54) PATIENT LIFT

(75) Inventors: Reza Hakamiun, Charleston; Douglas P. Genereux, North Charleston; Michael D. Falin, Summerville; Michael J. Mutka, North Charleston; Jason Conard Brooke, Mount Pleasant, all of SC (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/365,076

(22) Filed: Jul. 30, 1999

Related U.S. Application Data

(60) Provisional application No. 60/094,995, filed on Jul. 31, 1998.

(51) Int. Cl.[7] ..... A61G 7/10

(52) U.S. Cl. ..... 5/89.1; 5/87.1; 5/83.1; 5/86.1

(58) Field of Search ..... 5/86.1, 89.1, 81.1 R, 5/83.1, 81.1 T, 87.1; 294/140, 152, 74; 212/264

(56) References Cited

U.S. PATENT DOCUMENTS

| | | | |
|---|---|---|---|
| D. 186,506 | 11/1959 | Rosenberg . | |
| D. 197,789 | 3/1964 | Fleeber . | |
| D. 202,082 | 8/1965 | Reimold et al. . | |

(List continued on next page.)

FOREIGN PATENT DOCUMENTS

| | | | | |
|---|---|---|---|---|
| 241096 | * | 7/1987 | (EP) | 5/87.1 |
| 0 805 668 B1 | | 1/1999 | (EP) . | |
| 2414909 | * | 8/1979 | (FR) | 5/87.1 |
| 2461492 | * | 3/1981 | (FR) | 5/87.1 |
| 867149 | * | 5/1961 | (GB) | 5/87.1 |
| 2672 | * | 11/1918 | (NL) | 5/89.1 |
| 90/01916 | * | 3/1990 | (WO) | 5/87.1 |
| WO 97/17048 | | 5/1997 | (WO) . | |
| WO 97/30675 | | 8/1997 | (WO) . | |

OTHER PUBLICATIONS

Parker Bath Corporation, Alpine 600 Patient Lift, User Instructions, 12 pages, date unknown.
Oxford Hoist Company Ltd., Standaid 135 Patient Hoist, User Instructions, 11 pages, date unknown.
Arjo, Slings/Harnais/Sollevatori/Vaky/Gurte/Tilvesten/Slyngor/Lofteseil/Sejl/Slings, Information brochure, 3 pages, date unknown.
Arjo, Maximove™, Operating Instructions, 27 pages, date unknown.
Arjo, Maximove™, Assembly from Packaging Instructions (Powered Patient Positioning Spreader Bar), brochure, 4 pages, date unknown.
Arjo, Scoop Stretcher™, Operating Instructions Supplement, 8 pages, date unknown.
Arjo, Maximove™, Operating Instructions Supplement (Scale), 6 pages, date unknown.
Arjo, Maximove™, Operating Instructions Supplement (Parallel Chassis), 4 pages, date unknown.
Arjo, Maximove™, Operating Instructions Supplement (Powered Patient Positioning Spreader Bar), 4 pages, date unknown.

(List continued on next page.)

*Primary Examiner*—Lynne H. Browne
*Assistant Examiner*—Robert G. Santos
(74) *Attorney, Agent, or Firm*—Barnes & Thornburg

(57) ABSTRACT

An assembly for lifting, supporting and transporting a person which includes a base, a frame extending upwardly from the base, a lifting arm pivotally coupled to an upper end of the frame, an actuator coupled to the lifting arm for moving the lifting arm between the lowered position and a raised position, and an attachment bar coupled to the lifting arm. A person to be lifted is secured in a sling assembly which includes attachment loops that can be coupled to the attachment bar. The apparatus can also include a scale that can be used to weigh a person being lifted.

40 Claims, 6 Drawing Sheets

U.S. PATENT DOCUMENTS

| | | | | |
|---|---|---|---|---|
| D. 247,458 | | 3/1978 | Johansson . | |
| D. 327,762 | | 7/1992 | Silbersky et al. . | |
| D. 327,763 | | 7/1992 | Silbersky et al. . | |
| D. 329,112 | | 9/1992 | Silbersky et al. . | |
| D. 355,293 | | 2/1995 | Parker . | |
| D. 372,982 | | 8/1996 | Williams . | |
| D. 376,886 | | 12/1996 | Dunn et al. . | |
| 1,789,025 | | 1/1931 | Shepard et al. . | |
| 1,876,832 | | 9/1932 | Bancroft . | |
| 1,878,785 | | 9/1932 | Leavitt . | |
| 1,971,294 | | 8/1934 | Bunker . | |
| 2,821,406 | * | 1/1958 | Hoyer et al. | 5/83.1 X |
| 2,903,238 | * | 9/1959 | Flandrick | 5/83.1 X |
| 3,013,282 | * | 12/1961 | Volavsek | 5/627 |
| 3,099,842 | | 8/1963 | Jensen . | |
| 3,131,404 | * | 5/1964 | Bowers et al. | 5/86.1 |
| 3,137,011 | | 6/1964 | Fischer . | |
| 3,172,551 | | 3/1965 | Wolfe . | |
| 3,203,009 | | 8/1965 | Lundberg . | |
| 3,222,029 | | 12/1965 | Hildemann . | |
| 3,234,568 | | 2/1966 | Fischer . | |
| 3,351,959 | | 11/1967 | Turpin . | |
| 3,407,413 | | 10/1968 | James . | |
| 3,732,584 | | 5/1973 | James . | |
| 3,790,974 | | 2/1974 | Johansson . | |
| 3,829,916 | | 8/1974 | James . | |
| 3,962,737 | | 6/1976 | James . | |
| 3,983,584 | | 10/1976 | Holecek . | |
| 3,996,632 | | 12/1976 | Bakker nee Viel . | |
| 3,998,284 | | 12/1976 | James . | |
| 3,999,227 | | 12/1976 | Ingemansson . | |
| 4,003,479 | | 1/1977 | Reyer . | |
| 4,010,499 | | 3/1977 | Davis et al. . | |
| 4,015,725 | | 4/1977 | Ryan et al . | |
| 4,070,721 | | 1/1978 | Stasko . | |
| 4,075,719 | | 2/1978 | Sullivan . | |
| 4,091,479 | | 5/1978 | Hancock . | |
| 4,095,677 | | 6/1978 | Johannson . | |
| 4,117,561 | | 10/1978 | Zamotin . | |
| 4,125,908 | | 11/1978 | Vail et al. . | |
| 4,138,750 | | 2/1979 | Michalowski . | |
| 4,144,713 | | 3/1979 | Clark et al. . | |
| 4,206,523 | | 6/1980 | James . | |
| 4,232,412 | | 11/1980 | Petrini . | |
| 4,255,823 | | 3/1981 | Boyer et al. . | |
| 4,278,387 | | 7/1981 | Seguela et al. . | |
| 4,296,509 | | 10/1981 | Simmons et al. . | |
| 4,372,452 | | 2/1983 | McCord . | |
| 4,399,570 | | 8/1983 | Tracy et al. . | |
| 4,399,572 | | 8/1983 | Johansson . | |
| 4,484,366 | * | 11/1984 | Koortz | 5/83.1 |
| 4,487,019 | | 12/1984 | Johansson . | |
| 4,571,758 | | 2/1986 | Samuelsson . | |
| 4,588,155 | | 5/1986 | James . | |
| 4,592,695 | | 6/1986 | McConnell . | |
| 4,627,119 | | 12/1986 | Hachey et al. . | |
| 4,633,538 | | 1/1987 | James . | |
| 4,639,955 | | 2/1987 | Carminati et al. . | |
| 4,712,257 | | 12/1987 | James . | |
| 4,719,655 | | 1/1988 | Dean . | |
| 4,739,526 | | 4/1988 | Hollick . | |
| 4,742,588 | * | 5/1988 | James | 5/83.1 |
| 4,882,798 | | 11/1989 | Worsnop . | |
| 4,903,355 | * | 2/1990 | Hickerson | 5/83.1 |
| 4,920,590 | | 5/1990 | Weiner . | |
| 4,944,056 | | 7/1990 | Schroeder et al. . | |
| 4,944,057 | | 7/1990 | Shaw . | |
| 4,947,497 | | 8/1990 | Marchand . | |
| 4,969,221 | | 11/1990 | Foster . | |
| 4,999,862 | | 3/1991 | Hefty . | |
| 5,018,933 | | 5/1991 | Kramer . | |
| 5,022,106 | | 6/1991 | Richards . | |
| 5,072,840 | | 12/1991 | Asakawa et al. . | |
| 5,103,509 | | 4/1992 | Richards . | |
| 5,309,584 | | 5/1994 | Parker . | |
| 5,333,333 | | 8/1994 | Mah . | |
| 5,337,908 | | 8/1994 | Beck, Jr. . | |
| 5,348,273 | | 9/1994 | Sandell et al. . | |
| 5,355,538 | | 10/1994 | Fulford et al. . | |
| 5,369,821 | | 12/1994 | Richards et al. . | |
| 5,396,670 | * | 3/1995 | Firebaugh et al. | 5/89.1 |
| 5,412,820 | | 5/1995 | Richards . | |
| 5,442,821 | * | 8/1995 | Weeks | 5/89.1 X |
| 5,530,975 | * | 7/1996 | Firebaugh et al. | 5/81.1 T |
| 5,615,426 | * | 4/1997 | Hokett | 5/89.1 |
| 5,682,630 | | 11/1997 | Simon . | |
| 5,685,033 | | 11/1997 | Lavin . | |
| 5,692,253 | | 12/1997 | Keijser et al. . | |
| 5,694,654 | | 12/1997 | Roy . | |
| 5,697,109 | | 12/1997 | Hodgetts . | |
| 5,697,110 | | 12/1997 | Campbell . | |
| 5,708,993 | | 1/1998 | Campbell et al. . | |
| 5,711,044 | | 1/1998 | Newman et al. . | |
| 5,729,843 | | 3/1998 | Manthey . | |
| 5,758,371 | | 6/1998 | VanDyke et al. . | |
| 5,784,729 | | 7/1998 | Dunn et al. . | |
| 5,802,633 | | 9/1998 | Capaldi . | |
| 5,809,591 | | 9/1998 | Capaldi et al. . | |
| 5,810,104 | | 9/1998 | Campbell . | |
| 5,819,338 | | 10/1998 | Hession . | |
| 5,845,348 | | 12/1998 | Dunn et al. . | |
| 5,853,015 | | 12/1998 | Evans . | |
| 6,039,376 | * | 3/2000 | Lopreiato | 294/152 |
| 6,073,280 | * | 6/2000 | Farnum | 5/89.1 |
| 6,092,247 | * | 7/2000 | Wilson | 5/86.1 |
| 6,122,778 | * | 9/2000 | Cohen | 5/81.1 R |
| 6,161,233 | * | 12/2000 | von Schroeter et al. | 5/81.1 R |
| 6,175,973 | * | 1/2001 | Hakamiur et al. | 5/89.1 |
| 6,219,862 | * | 4/2001 | Horcher et al. | 5/89.1 |

OTHER PUBLICATIONS

Arjo, Maximove™, Assembly from Packaging Instructions (Parallel Chassis), 4 pages, date unknown.

Arjo, Maximove™, Operating Instructions Supplement (Strap Stretcher), 3 pages, date unknown.

Arjo, Maximove™, Assembly from Packaging Instructions, 3 pages, date unknown.

Arjo, Marisa™, Operating Instructions, 21 pages, date unknown.

Arjo, Marisa™, Assembly from Packaging Instructions, 4 pages, date unknown.

Medcare Lifts & Stands, Operator's Manual, 12 pages, date unknown.

Medi–Man Rehabilitation Products Inc., The Medi–Maid II (sit/stand lift) brochure, 2 pages, 03/97.

Medi–Man Rehabilitation Products, Inc., Le Medi–Lifter III (Levage Total) brochure, 2 pages, 09/96.

Island Distributing, Vander–lift Electric Patient Lifting and Transfer Units, 2 pages, date unknown.

Island Distributing, Vera Electric Patient Lifting and Transfer Units brochure, 2 pages, date unknown.

Medi–Man Rehabilitation, Medi–SSL, Model 4000–SSL, Assembly Instructions, 4 pages, date unkown.

Medi–Man Rehabilitation Products, Inc., The Medi–SSL Adjustable Model 4000–SSL, 26 pages, 1996.

Medi–Man Rehabilitation Products, Inc., Model 7000 Quality Inspection Checklist, 1 page, 1996.

Medi–Man Rehabilitation Products, Inc., The Medi–Lifter III Model 7000 Operator's Manual, 23, pages, 1996.

Handi–Move N.V., handi® move brochure, 8 pages, date unknown.

* cited by examiner

PATIENT LIFT

The present application is based upon and claims the benefit of U.S. Provisional Application Ser. No. 60/094,995, filed Jul. 31, 1998, the complete disclosure of which is expressly incorporated herein by reference.

BACKGROUND AND SUMMARY OF THE INVENTION

The present invention relates to a lift apparatus, and particularly to a lift apparatus that can be used to lift and move non-ambulatory patients or invalids.

It is known to provide a patient lift to hoist patients into the air. For example, prior art devices have a base that supports the lift apparatus on the floor, a frame that extends up from the base, a lifting arm that is coupled to the frame for movement from a lowered position to a raised position, and an actuator that drives the lifting arm. A sling is provided that is wrapped around the patient and coupled to the lifting arm to support him or her as the lift hoists the patient into the air.

Patient lifts are typically used in hospitals, and the base usually has wheels to facilitate convenient placement of the lift, such as adjacent a bed. The sling is wrapped around the patient and attached to the lift arm to support and retain the patient during the lifting operation. A patient lift provides a useful mechanism to move an incapacitated patient, for example, from a bed to a wheel chair or to a bath. Compared with manually lifting the patient, patient lifts reduce the risk of accident as well as physical stress on caregivers such as nurses, who often are relatively much smaller than patients.

According to other features, characteristics, embodiments and alternatives of the present invention which will become apparent as the description thereof proceeds below, the present invention provides a patient lift apparatus which includes a base, a frame extending upwardly from the base, and a lifting arm pivotally coupled to the frame for movement of the lifting arm between a lowered position and a raised position. The apparatus also includes an actuator coupled to the lifting arm for moving the lifting arm between the lowered position and a raised position, and an attachment bar coupled to the lifting arm. The attachment bar has laterally spaced apart first and second sling hooks for receiving a sling assembly. The apparatus further includes a sling assembly configured to be coupled to the attachment bar to hold a patient off the ground. The sling assembly includes a support surface, left and right upper loop assemblies coupled to the support surface, and left and right lower loop assemblies coupled to the support surface. The left upper loop assembly and right lower loop assembly are configured to be coupled to the first sling hook, and the right upper loop assembly and left lower loop assembly configured to be coupled to the second sling hook.

The present invention also provides a patient lift apparatus which includes a base, a frame extending upwardly from the base, and a lifting arm pivotally coupled to the frame for movement of the lifting arm between a lowered position and a raised position. The apparatus also includes an actuator coupled to the lifting arm for moving the lifting arm between the lowered position and a raised position, and an attachment bar coupled to the lifting arm. The attachment bar has laterally spaced apart first and second sling hooks, and a mounting bolt extending upwardly between the first and second sling hooks. The mounting bolt is pivotally coupled to a mounting bracket to allow rotation of the attachment bar relative to the lifting arm about an axis extending through the mounting bolt. The apparatus further includes a sling assembly configured to be coupled to the attachment bar for holding a patient off the ground. The sling assembly includes a support surface, left and right upper loop assemblies coupled to the support surface, and left and right lower loop assemblies coupled to the support surface. The left upper loop assembly and right lower loop assembly are configured to be coupled to the first sling hook, and the right upper loop assembly and left lower loop assembly configured to be coupled to the second sling hook.

In another embodiment of the present invention, a weigh scale is coupled between the lifting arm and the mounting bracket coupled to the attachment bar. Therefore, the patient lift apparatus provides an indication of the weight of the patient supported in the sling assembly.

Additional features and advantages of the present invention will become apparent to those skilled in the art upon consideration of the following detailed description of illustrated embodiments exemplifying the best mode of carrying out the invention as presently perceived.

BRIEF DESCRIPTION OF DRAWINGS

The present invention will be described hereafter with reference to the attached drawings which are given as non-limiting examples only, in which.

DETAILED DESCRIPTION OF THE DRAWINGS

The present invention is directed to an apparatus which can be used to lift, support and transport patients in health and home care environments. The apparatus includes a lifting mechanism and a sling that is configured to cradle a patient and be attachable to the lifting mechanism, The lifting mechanism includes a base which is designed to steadily support the apparatus while a person is supported and transported thereby, a frame which extends upwards from the base, and a lifting arm which is pivotally coupled to the frame.

A mechanical or motorized actuator is coupled between the frame and the lifting arm. Operation of the actuator causes the lifting arm to pivot about its attachment point to the frame between raised and lowered positions.

The sling includes attachment loops that are configured to be attachable to hooks of an attachment bar that is coupled to the lifting arm. The attachment arm can be coupled to the lifting arm in such a manner to allow pivotal and rotational movement thereof with respect to the lifting arm.

According to one embodiment, the attachment bar includes two spaced apart hook elements to which four attachment loops of the sling can be attached. In another embodiment, the attachment bar includes four spaced apart hook elements to which four attachment loops of the sling can be attached.

The lifting assembly of the present invention can be provided with a scale that can be used to determine the weight of a person being lifted. The scale can be incorporated into the lifting assembly at any convenient location. According to one embodiment, a lift scale is provided between the attachment bar and the lifting arm.

Figure 1:
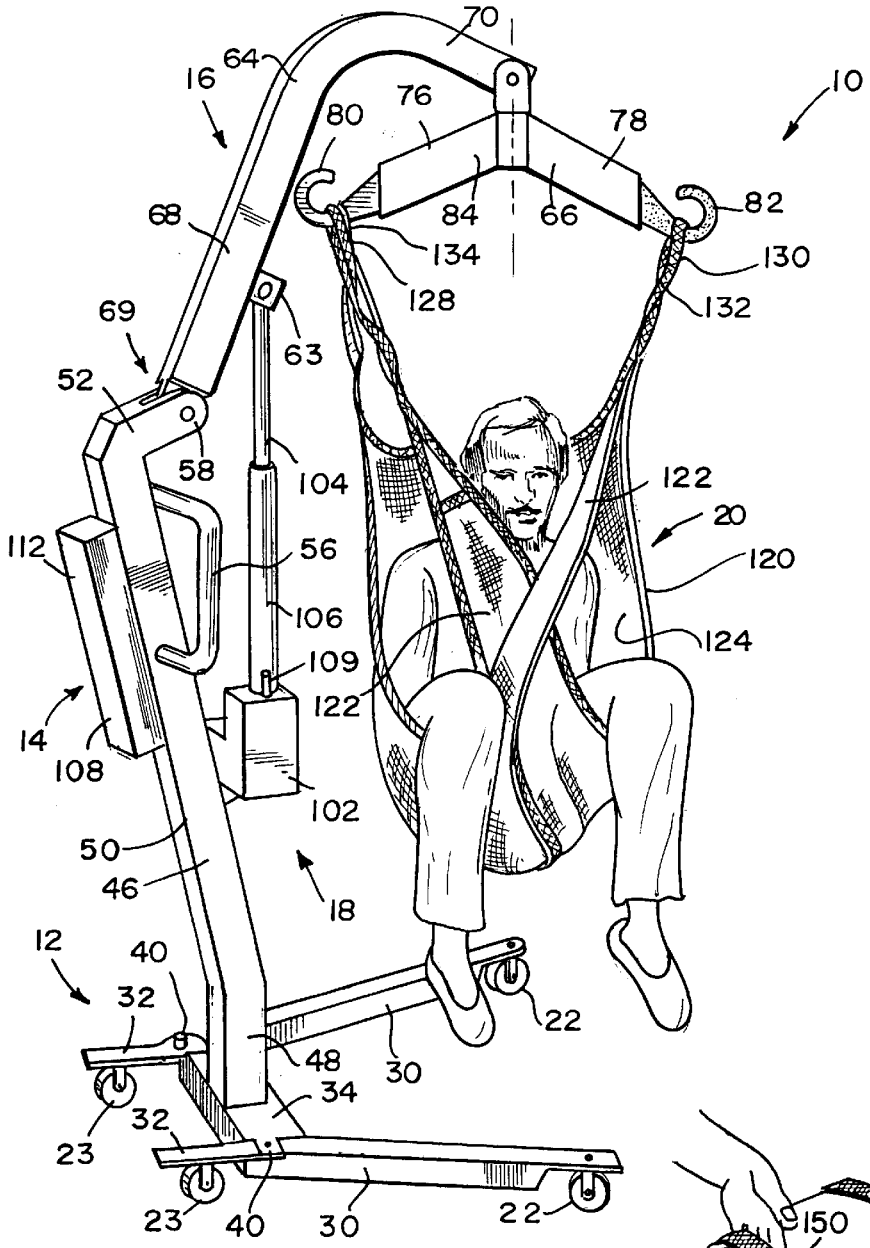
FIG. 1 is a perspective view of a patient lift apparatus according to one embodiment of the present invention.
Figure 2:
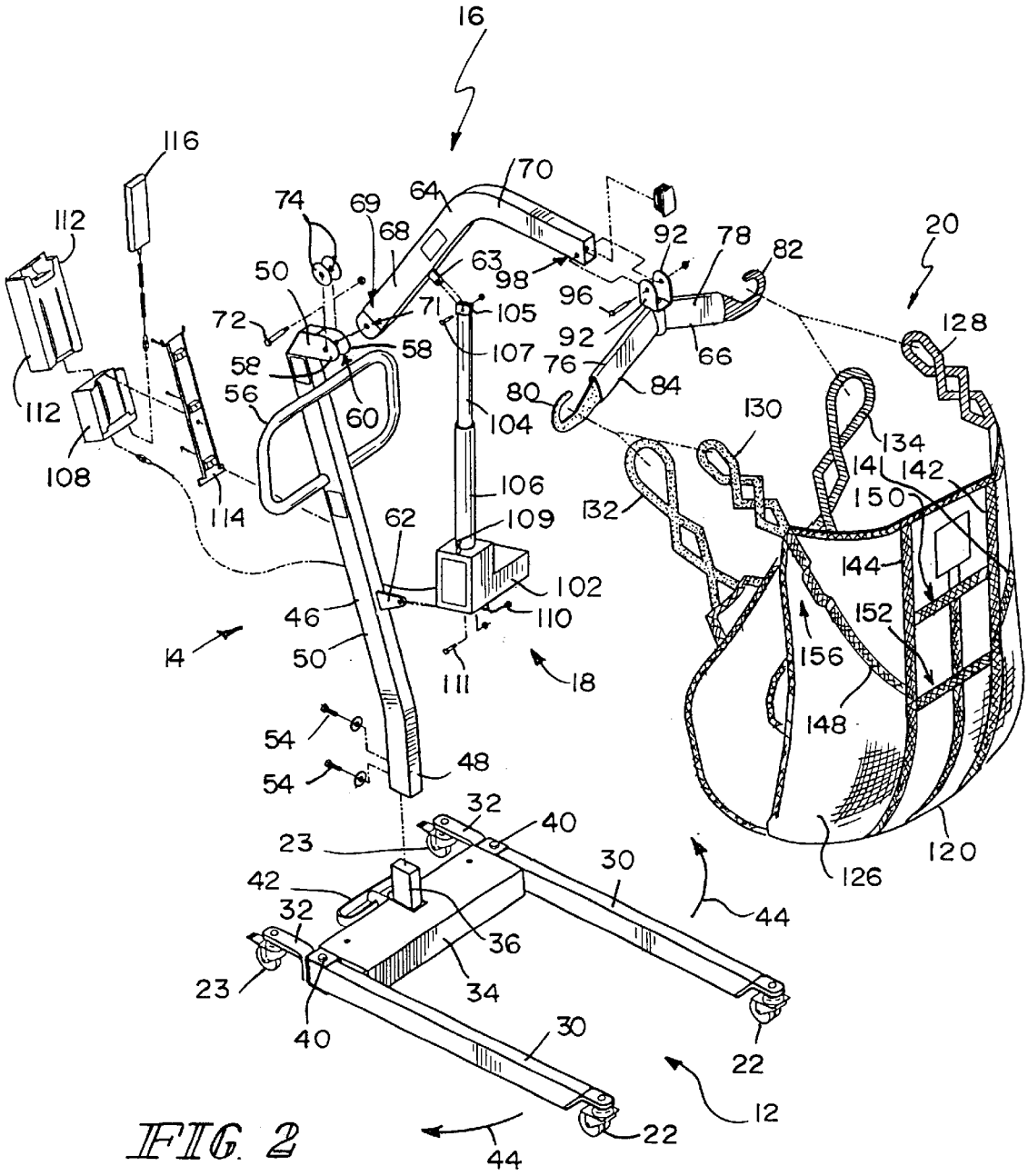
FIG. 2 is an exploded perspective view of the patient lift apparatus of FIG. 1.

FIG. 1 is a perspective view of a patient lift apparatus 10 according to one embodiment of the present invention. FIG. 2 is an exploded perspective view of the patient lift apparatus 10 of FIG. 1. According to the present invention, the patient lift 10 includes a base 12, a frame 14 that extends upwardly from base 12, a lifting arm assembly 16 pivotally coupled to frame 14, an actuator 18 coupled to frame 14 and to lifting arm assembly 16, a sling attachment bar 66, and a sling assembly 20.

Actuator 18 is used to move lifting arm assembly 16 between a lowered position in which a person sitting in the sling assembly 20 can be lowered onto or lifted off a seat, bed, etc., and a raised position as shown in FIG. 1, in which the person is suspended in the sling assembly 20. Patient lift 10 further includes a plurality of casters 22 and 23 coupled to base 12 to facilitate moving lift 10. The casters 22 and 23 allow movement of the patient lift 10 while a person is suspended in the sling assembly 20.

Components of patient lift 10, such as base 12, frame 14, and lifting arm assembly 16 illustratively are formed using conventional rectangular and round tubular metal parts to provide for high structural strength while providing for relatively inexpensive manufacturing costs. Similarly, sling assembly 20 is formed using a standard material, illustratively polyester, to provide for high strength and low cost. Furthermore, a commercial, off-the-shelf component can be used for actuator 18, such as a model LA34 actuator available from LINAK U.S. Inc. in Louisville, Ky. Patient lift 10 thus provides a reliable, cost-efficient device suitable for use in applications where there is a need for lifting and/or moving patients. Those skilled in the art will appreciate that other suitable well-known materials can be used to construct components of lift 10 and other types of actuators can be provided to cause movement of lift arm assembly 16. In other words, it is understood that the present invention is not limited to the use of LINAK actuators, and that similar electro-mechanical actuators or manually operable mechanisms, winches, rack and pinion assemblies, etc. can be used.

Base 12 includes a pair of elongated front legs 30, a pair of rearwardly extending caster brackets 32, a cover plate or base housing 34 coupled to legs 30, and a frame mounting post 36 extending upwardly from cover plate or base housing 34 as shown in FIG. 2. Two pairs of casters 22, 23 are coupled to legs 30 and caster brackets 32, respectively. Casters 22 are illustratively dual wheel casters having rubber treads and casters 23 are illustratively single wheel casters having rubber treads and wheel/swivel locks.

Legs 30 are coupled to cover plate or base housing 34 by a pivot 40, and cover plate or base housing 34 is further coupled to a leg-spreader pedal 42 shown in FIG. 2. A leg-spreading assembly (not shown) situated inside cover plate or base housing 34 is coupled to pedal 42 and legs 30. Legs 30 move in response to movement of pedal 42. The leg-spreader assembly allows for the spreading of legs 30 outwardly about pivots 40 as shown by arrows 44 in FIG. 2 to increase the stability of lift assembly 10. The leg-spreading assembly can be any suitable device that allows an operator to rotate legs 30, such as a tie-rod assembly, a screw-drive assembly, or a cam-actuated assembly. An electromechanical actuator (not shown) can also be used as the leg-spreading assembly. Legs 30 alternatively can be rotated without using pedal 42 by applying force directly to legs 30. For manually rotatable legs, locking pins or braces can be provided to maintain desired positions of the legs 30.

Frame 14 includes a column 46 having a vertical lower section 48, a rearwardly slanted middle section 50, and a forwardly extending upper section 52. Lower section 48 of column 46 is configured to fit on mounting post 36 and can be coupled thereto by a pair of mechanical fasteners such as bolts 54. A handle 56 formed as a rounded rectangle is coupled to upper section 50 of column 46 to provide a caregiver with a convenient mechanism for moving patient lift 10. In alternative embodiments, a pair of linear or curved handles could extend from either side of middle section 50 of column 46. Upper section 52 of column 46 includes a yoke structure that is defined by a pair of spaced-apart flanges 58 each having a pin-receiving hole 60 for pivotally coupling lifting arm assembly 16 to frame 14.

Middle section 50 of column 46 includes an actuator mount 62 for pivotally coupling actuator 18 to frame 14. Lifting arm assembly 16 includes a main arm 64 which is pivotally coupled both to upper section 52 of column 46 and to actuator 18. The distal end of main arm 64 of lifting arm assembly 16 is pivotally and rotatably attached to a sling attachment bar 66 as discussed in detail below.

Main arm 64 of the lifting arm assembly 16 has a rounded, generally L-shaped profile with a longer first section 68 and a shorter second section 70. First section 68 has a proximal end 69 with a pin-receiving aperture 71 by which the first section can be pivotally coupled to upper section 52 of column 46, between flanges 58 by a pin 72 and washers 74 shown in FIG. 2. It is understood that other pivotal connections and coupling arrangements can be used, such as any type of hinge coupling formed between main arm 64 and frame 14. First section 68 further includes an actuator coupling bracket 63 for pivotally coupling main arm 64 to actuator 18 as discussed below.

Sling attachment bar 66 includes left and right laterally disposed side arms 76 and 78 having left and right color coded sling attachment hooks 80 and 82. Arms 76, 78 have a relatively thick cross-section to provide for suitable structural strength for lifting patients of any weight. Left hook 80 is illustratively color coated with a red outer layer and right hook 82 is color coated with a green layer. It is understood that any suitable color, combination of colors, or other visual indicia can be used. Color coding of hooks 80 and 82 facilitates proper coupling of sling assembly 20 to attachment bar 66 as discussed in more detail below.

Figure 3:
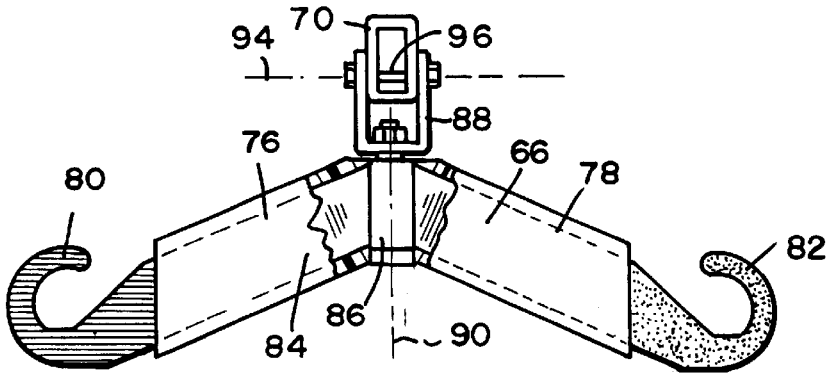
FIG. 3 is a front view of a sling attachment bar according to one embodiment of the present invention.

FIG. 3 is a front view of a sling attachment bar according to one embodiment of the present invention. The sling attachment bar 66 includes a central portion that can be covered by a foam or rubber sheath 84 to soften contact when a patient or caregiver accidentally bumps into the sling attachment bar 66. The foam or rubber sheath 84 can have a generally elliptical cross-sectional shape which is hollow for receiving and covering portions of arms 76 and 78 and bolt 86.

The side arms 76 and 78 can be attached, e.g. welded, to a shoulder bolt 86 that in turn can be rotationally coupled to an attachment bar mounting bracket 88 as best shown in FIG. 3. Shoulder bolt 86 has a vertical axis 90 about which attachment bar 66 can rotate. Mounting bracket 88 is a yoke-shaped structure that includes a pair of lateral holes 92, shown in FIG. 2, that together define a lateral axis 94 which is perpendicular to vertical axis 90 as shown in FIG. 3. Bracket 88 is coupled to the distal end of the main arm 64 by a bolt 96 that extends through holes 92 and an aperture 98 located adjacent the distal end of the main arm 64 as shown in FIG. 2. The sling attachment bar 66 is allowed to rotate about lateral axis 94 as lift arm assembly is moved up and down by actuator 18. Mounting bracket 88 thus provides for two degrees of rotational freedom between lifting arm 64 and sling attachment bar 66 to provide flexibility in operation of patient lift 10 when hoisting the patient into the air.

Patient lift actuator 18 is illustratively a commercially available LINAK model LA34 electro-mechanical actuator having a DC motor 102 and an extendable cylinder 104 that extends and retracts within an outer cylinder 106 as commanded by a controller 108. Extendable cylinder 104 includes a distal bracket 105 that is pivotally coupled to lifting arm actuator coupling bracket 63 by a pin 107. Motor 102 includes a bottom bracket 110 that is pivotally coupled by a pin 111 to frame actuator mount 62. Actuator 18 is thus pivotally coupled at both ends to move as required during actuation of patient lift 10.

Controller 108 is illustratively a battery-operated model CBJ1 from LINAK that provides for controlling an optional leg-spreader actuator (not shown). A battery 112 provides power for controller 108 and motor 102. Battery 112 may be removed from lift 10 for recharging by a separate battery charger (not shown). Controller 108 and battery 112 are coupled to the middle section 50 of column 46 by a mounting plate 114 shown in FIG. 2. Controller 108 also includes a hand set 116 coupled to controller 108 by a flexible coil. Hand set 116 includes a magnet to allow for convenient, temporarily coupling of hand set 116 to any ferrous metal component of patient lift 10. Alternatively, the hand set 116 can be removable coupled to the controller 108 by any suitable means such as a cradle, clip, VELCRO, etc.

Controller 108 provides an electric emergency lowering capability that operates to allow lowering of lifting arm assembly 16 by a caregiver in an emergency. The emergency lowering feature is activated by inserting a pen or other suitably sized object into an aperture in a face plate (not shown) of controller 108. This causes a connection directly from the battery to the actuator and bypasses controller circuitry in case of a failure of any components. A mechanical quick release ring or pin 109 is provided on actuator 102 for fast, stepless retraction of extendable cylinder 104. The quick release is activated by pulling release ring or pin 109, which causes a wrap spring inside outer cylinder 106 to expand its diameter and allows a clutch housing to rotate so that extendable cylinder 104 can retract. An adjuster (not shown) is optionally provided for switching between a fast speed and a slower speed of retraction for extendable cylinder 104.

Figure 4:
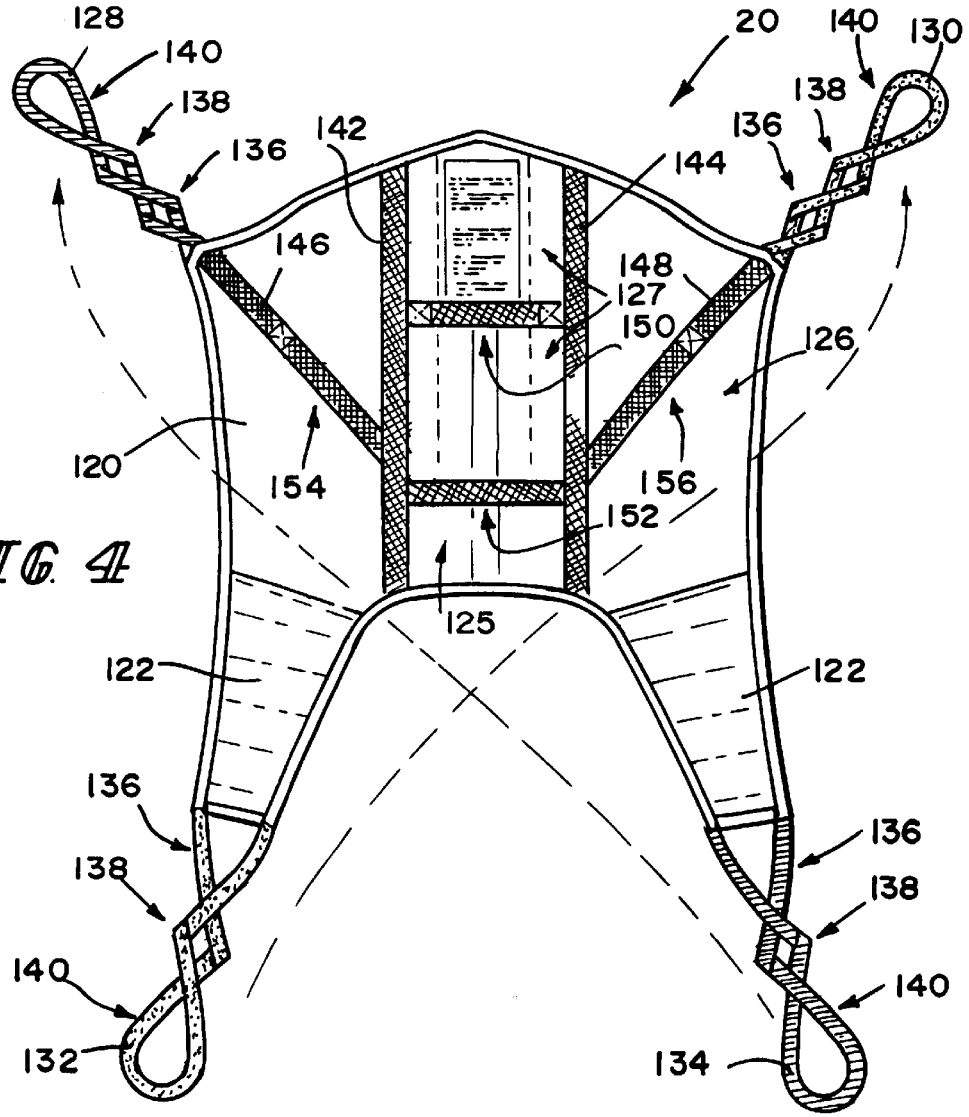
FIG. 4 is a plan view of the back of the sling assembly of FIG. 1.

FIG. 4 is a plan view of the back of the sling assembly of FIG. 1. Sling assembly 20 includes a main body-supporting portion 120 and a pair of leg sections 122. Sling assembly 20 is configured to wrap around a patient and couple to lifting arm assembly 16 to hold the patient during operation of lift 10. Body-supporting portion 120 and leg sections 122 illustratively are formed from two layers of heavy duty polyester with foam material in between. Body-supporting portion 120 can include a more rigid foam material than leg section 122 as required to facilitate patient comfort and wrapping flexibility. Body-supporting portion 120 includes an inner, body-supporting surface 124, shown in FIG. 1, and an outer surface 126 shown in FIGS. 4 and 5. The body supporting portion 124 comprises a seat portion 125 and a torso portion 127 and a strap (shown as handle 152) extending therebetween. It is to be understood that body-supporting portion 120 and leg sections 122 can be formed from any flexible, suitably strong material, such as canvas, nylon, etc., and that any number of layers can be used, and that other padding material or no padding material can be used between layers.

Sling assembly 20 further includes four attachment straps 128, 130, 132 and 134 as best shown in FIG. 4. Attachment straps 128 and 130 extend from laterally spaced corners of body-supporting portion 120 and straps 132 and 134 extend from ends of leg sections 122. Attachment straps 128, 130, 132 and 134 are each looped and stitched together in an overlapped configuration to provide inner, middle, and outer attachment loops 136, 138 and 140 as shown in FIG. 4. Loops 136, 138 and 140 are configured to be retained by sling hooks 80 and 82 as shown in FIGS. 1 and 2. The inclusion of multiple loops allows for adjusting sling assembly 20 to accommodate persons of various sizes. It is understood that any number of attachment loops can be provided and that they can be coupled to the sling in any suitable manner. Attachment straps 128, 130, 132 and 134 are illustratively formed from high-strength polypropylene, although it is to be understood that any suitably strong, flexible material can be used.

Proper use of sling assembly 20 typically requires using matched-pairs of attachment straps 128, 130, 132 and 134 so that diagonally opposed straps 128 and 134 are coupled to sling hook 80 and diagonally opposed straps 130 and 132 are coupled to hook 82. Coupling diagonally opposed pairs of straps provides for securely retaining a patient within sling assembly 20 as shown in FIG. 1. In order to facilitate this, each of the diagonally opposed pairs of straps 128 and 134; and 130 and 132 can be provided with a color coding corresponding to the respective sling hooks 80, 82. Illustratively, straps 128 and 134 can be formed from red polypropylene to match the red coating of hook 80, and straps 130 and 132 can be formed from green polypropylene to match the green coating of hook 80. Thus, in order to properly couple sling assembly 20 to lifting arm assembly 16, the patient or caregiver need only ensure that the same color straps are looped onto the same color hooks. It is understood that other color coding schemes can be used, such as color coding only a portion of a strap, or using multiple colors, or using visual indicia other than color to match or correspond to the visual indicia on sling hooks 80, 82.

Sling assembly 20 further includes reinforcing straps 142, 144, 146 and 148 coupled to outer surface 126 of body-supporting portion 120 as best shown in FIG. 4. Reinforcing straps 142, 144, 146 and 148 are also illustratively formed from high-strength polypropylene stitched to body-supporting portion 120, although, any suitable material can be used. Reinforcing straps 142, 144 extend in a generally parallel direction laterally spaced apart from a vertical axis of symmetry of sling assembly 20 along the entire vertical dimension of body-supporting portion 120. Reinforcing straps 146 and 148 extend diagonally from respective top comers of body-supporting portion 120 where attachment straps 128 and 130 are coupled to connect with reinforcing straps 142 and 144.

Figure 5:
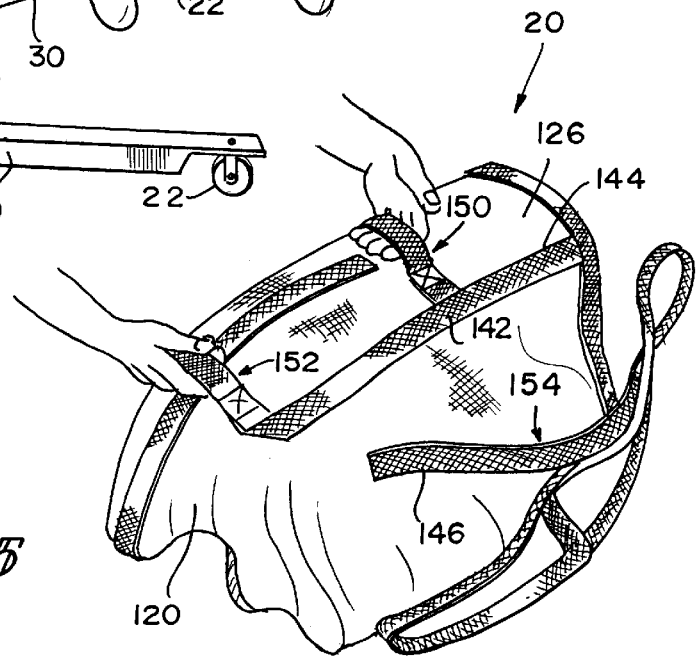
FIG. 5 is a perspective view showing caregiver handles on the sling assembly of FIG. 1.

FIG. 5 is a perspective view showing caregiver handles on the sling assembly of FIG. 1. Sling assembly 20 includes four caregiver handles 150, 152, 154 and 156. Caregiver handles 150 and 152, can be formed by sewing straps, e.g. polypropylene straps, to body-supporting portion 120 between reinforcing straps 142 5 and 144. Caregiver handles 154 and 156 can be formed by sewing reinforcing straps 146 and 148 to body supporting portion 120 so that a central section is detached from outer surface 126 whereby a caregiver can insert his or her hand thereunder. Caregiver handles 150, 152, 154 and 156 are coupled to reinforcing straps 142, 144, 146 and 148 so that when a caregiver uses the handles to assist a patient, as shown for example in FIG. 5, the force on caregiver handles 150, 152, 154 and 156 is transmitted more directly to lifting arm assembly 116 without causing undue stress on body-support piece 120. It is understood that other handle configurations can be used.

Figure 6:
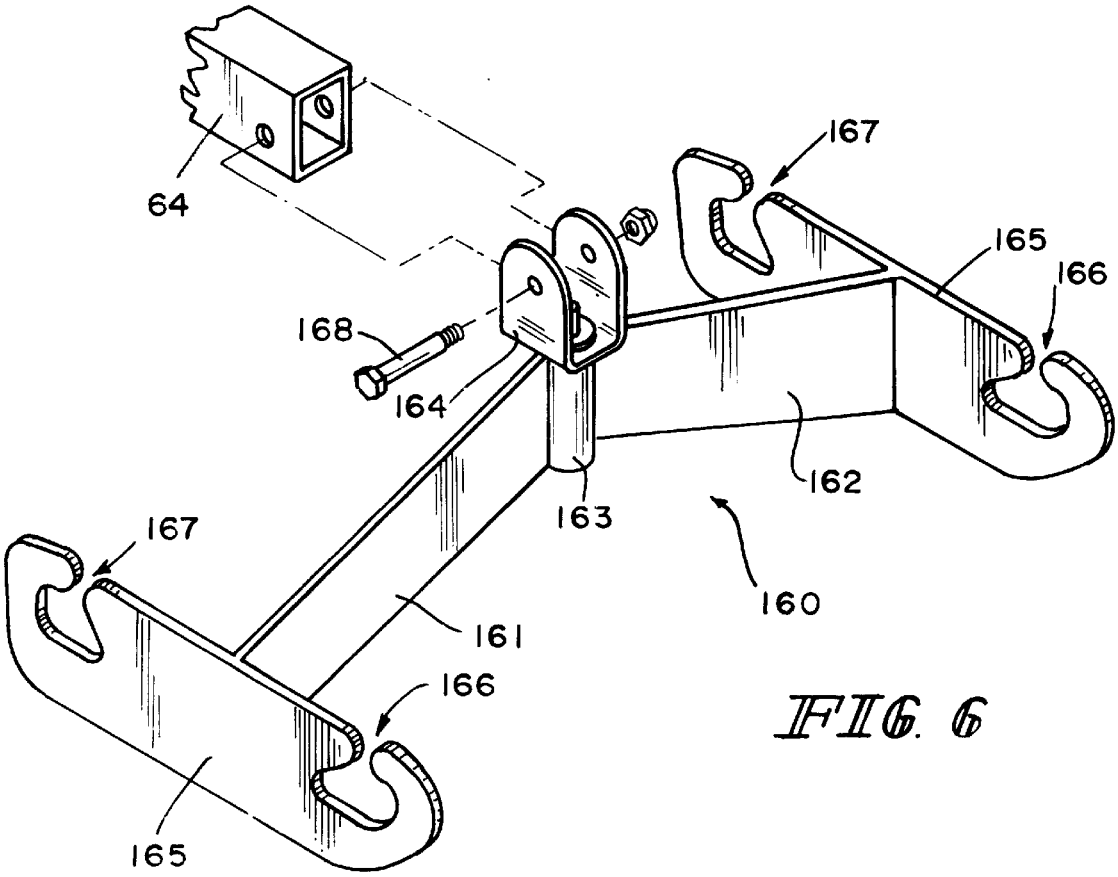
FIG. 6 is a perspective view of a sling attachment bar according to another embodiment of the present invention.

FIG. 6 is a perspective view of a sling attachment bar according to another embodiment of the present invention. The sling attachment bar 160 of FIG. 6 includes a pair of arms 161 and 162 which extend outwardly in an opposed manner from shoulder bolt 163. As depicted, the pair of arm members 161 and 162 can also extend slightly downward in order to provide additional clearance for accessing mounting bracket 164.

Hook brackets 165 are attached at opposite ends of the pair of arm members 161 and 162 as shown. The hook brackets 165 can be perpendicular to the arm members 161 and 162 and attached to thereto at their centers. Each end of the hook brackets 165 include hooks 166 and 167 which can be formed in any manner such as cutting out portions near the ends of the hook brackets 165. Although not shown, the pair of arms 161 and 162 and central and/or bottom portions of the hook brackets 165 can be padded, e.g. covered with a padding material such as foam or rubber.

As discussed below, the mounting bracket 164 of FIG. 6 allows the sling assembly 170 to be suspended in such a manner that the attachment straps thereof are all spaced apart. This arrangement will be more comfortable to some patients.

The mounting bracket 164 and shoulder bolt 163 can be similar to the mounting bracket 88 and shoulder bolt 86 in FIG. 3 which are discussed above. The mounting bracket 164 of FIG. 6 can be coupled to the distal end of the main arm 64 by bolt 168. In alternative embodiments, the arm members 161 and 162 of the sling attachment bar 160 could be attached to a cylindrical element having a through-bore through which a bolt can pass and be coupled to the mounting bracket 164.

Figure 7:
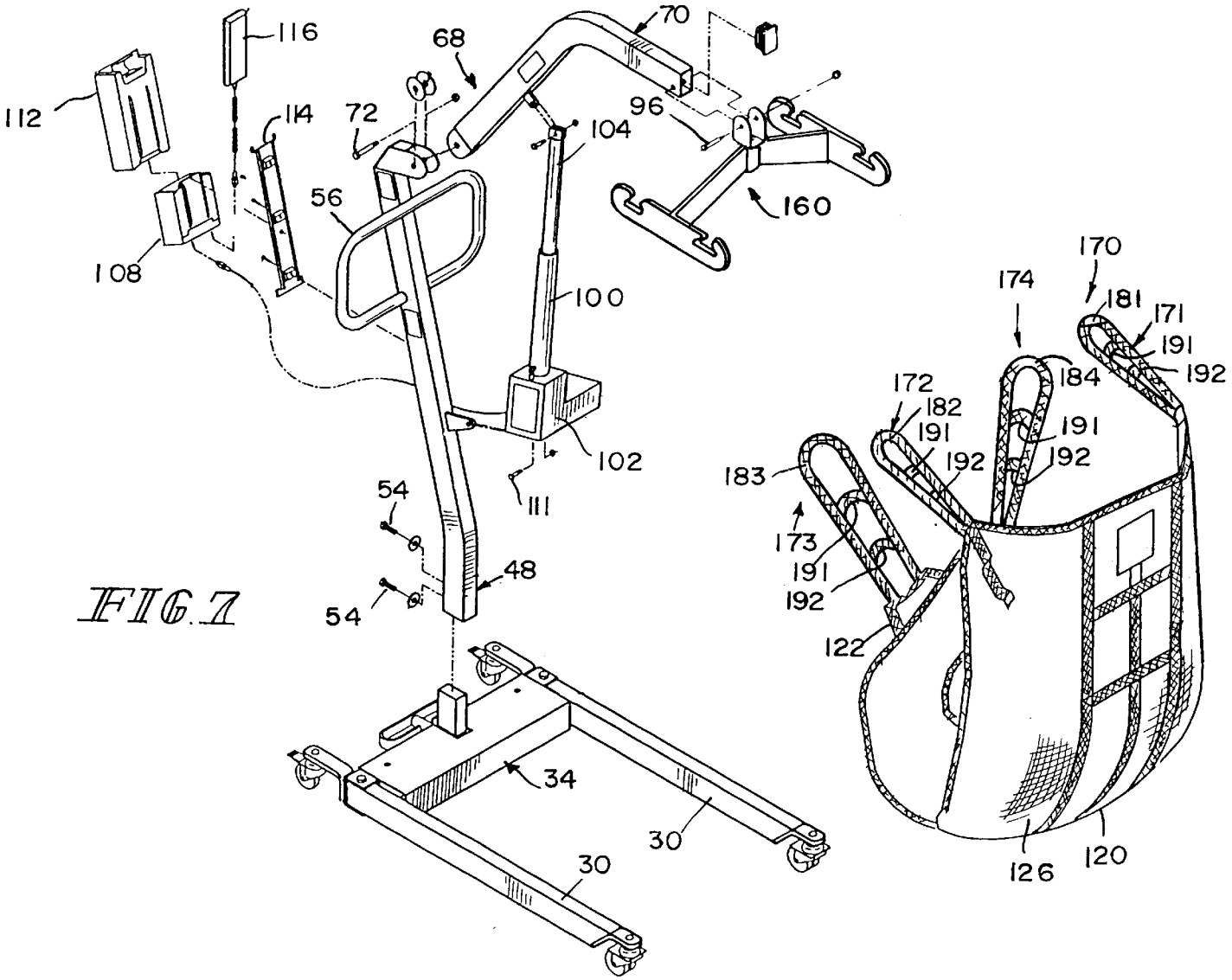
FIG. 7 is an exploded perspective view of a patient lift apparatus which utilizes the sling attachment bar of FIG. 6 and depicts an alternative sling assembly.

FIG. 7 is an exploded perspective view of a patient lift apparatus which utilizes the sling attachment bar of FIG. 6 and depicts a different sling assembly 170.

The sling assembly 170 of FIG. 7 is similar to the sling assembly of FIGS. 1–2 and 4–5, except in the manner in which the attachment straps are shaped. In the embodiment of the invention depicted in FIG. 7. Each of the four attachment straps 171, 172, 173 and 174 are formed as non-overlapped loops. Attachment straps 171 and 172 extend from laterally spaced corners of body-supporting portion 120 and straps 173 and 174 extend from ends of leg sections 122. Each attachment straps 171, 172, 173 and 174 include a primary or outer loop 181, 182, 183, and 184 that can be formed from a continuous loop of material. The primary or outer loops 181, 182, 183 and 184 are divided into two or more secondary or intermediate loops by lateral portions of strap material 191 and 192 which extend between sides of the primary or outer loops 181, 182, 183 and 184. It is to be understood that any number of secondary or intermediate loops can be used according to the present invention, even though only two are depicted in FIG. 7.

Proper use of sling assembly 170 typically requires using matched pairs of attachment strap loops. The attachment straps 173 and 174 which extend from ends of the leg sections 122 are crossed as depicted in FIG. 7 and connected to hooks 167. Attachment straps 171 and 172 which extend from laterally spaced corners of body-supporting portion 120 are connected to hooks 166 in an un-crossed manner. As discussed above, the attachment straps 171, 172, 173 and 174 and/or the loops thereof can be color coded together with the hooks 166 and 167.

Figure 8:
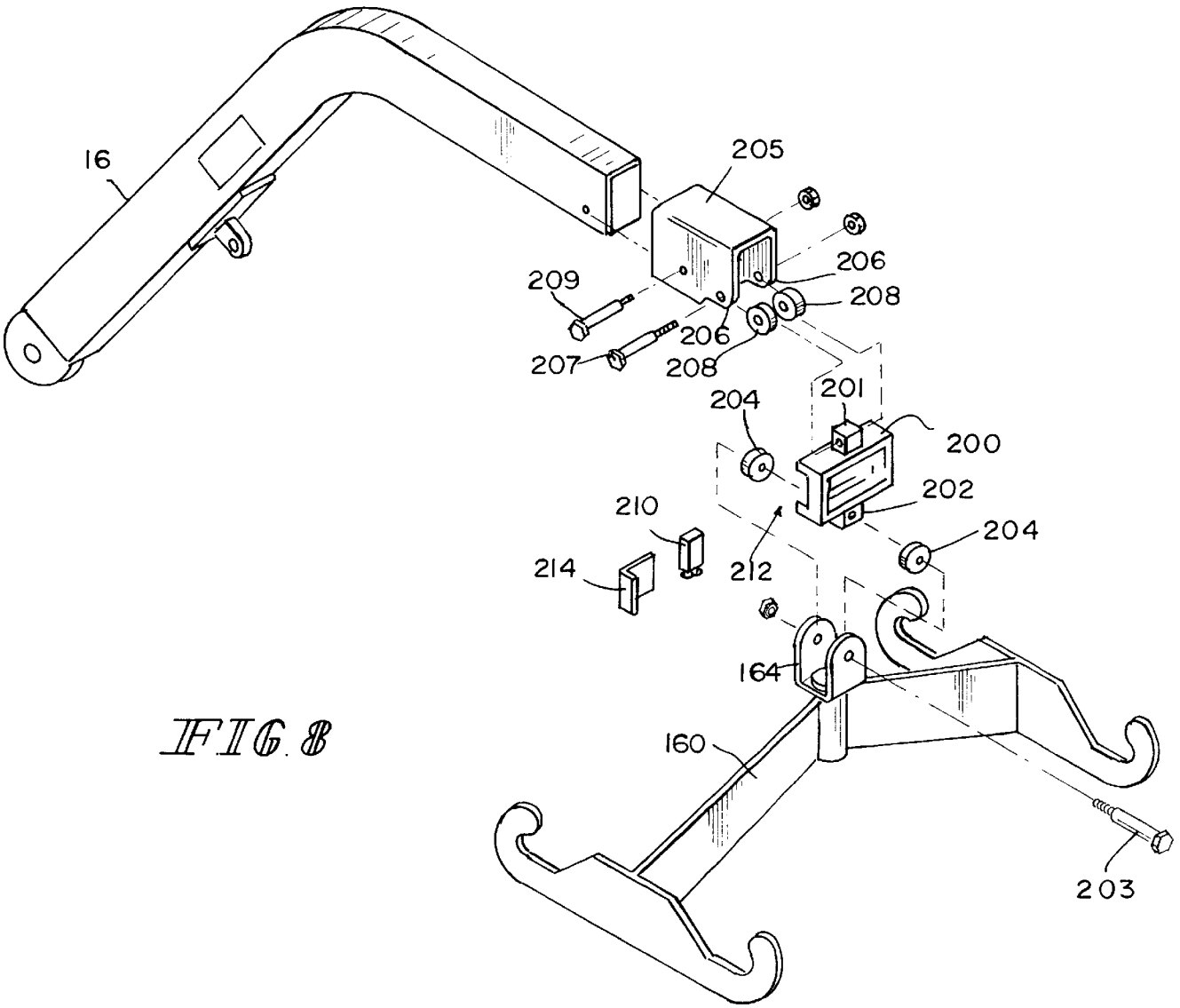
FIG. 8 is an exploded perspective view of a patient weighing assembly which can be incorporated between the lifting arm assembly and the sling attachment bar according to one embodiment.

FIG. 8 is an exploded perspective view of a patient weighing assembly which can be incorporated between the lifting arm assembly 16 and the sling attachment bar 160 according to one embodiment. In order to weigh a patient, it is possible according to the present invention to provide the patient lift 10 with a lift scale. As depicted in FIG. 8, such a lift scale 200 is incorporated between lifting arm assembly 16 and the sling attachment bar 160. Lift scale 200 is illustratively powered by a 9V battery 210 which fits within a recessed portion 212 of the lift scale 200. A cover 214 is removable from the lift scale 200 to expose the recessed portion 212.

In FIG. 8 lift scale 200 is provided with an upper mounting bracket 201 and a lower mounting bracket 202, each of which include a through-bore as depicted. The lower mounting bracket 202 is coupled to mounting bracket 164 that is coupled to a sling attachment bar 160. As depicted in FIG. 8, an elongate fastener 203 such as a pin, bolt, etc. is inserted through aligned through-bores in mounting bracket 164 of the sling attachment arm 160 and lower mounting bracket 202 of the lift scale 200. Also, spacers 204 are provided between mounting bracket 164 of the sling attachment arm 160 and lower mounting bracket 202 of the lift scale 200 as indicated.

The upper mounting bracket 201 of the lift scale 200 can be coupled to the distal end of the main arm 64, by either providing in arm assembly 16 a slot and/or ear projections with aligned through-bores, or providing a separate scale lift mount 205 which is coupled to the distal end of the main arm 64 and which includes a slot and/or ear projections 206 with aligned through-bores as shown. Scale lift mount 205 is secured to the distal end of the main arm 64 by means of one or more mechanical fasteners such as bolt 209.

As depicted in FIG. 8, an elongate fastener 207 such as a pin, bolt, etc. is inserted through aligned through-bores in scale lift mount 205 and upper mounting bracket 201 of the lift scale 200. Also, spacers 208 are provided between lift scale mount 205 and upper mounting bracket 201 of the lift scale 200 as indicated.

In other embodiments, a lift scale can be incorporated into the patient lift in any convenient location, such as for example in the base 12, frame 14, lifting arm assembly 16, etc.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed is:

1. A patient lift apparatus comprising:

a base;

a frame extending upwardly from the base;

a lifting arm pivotally coupled to the frame for movement of the lifting arm between a lowered position and a raised position;

an actuator coupled to the lifting arm for moving the lifting arm between the lowered position and a raised position;

an attachment bar coupled to the lifting arm, the attachment bar having first and second laterally spaced apart sling hooks; and a sling assembly configured to be coupled to the attachment bar to hold a patient off the ground, the sling assembly including a support surface for engaging a patient, and an outer surface facing opposite the support surface, a body supporting portion, left and right upper loop assemblies coupled to the body supporting portions, left and right leg and portions coupled to the body supporting portion, and, left and right lower loop assemblies coupled to the left and right leg portions, respectively, the left upper loop assembly and right lower loop assembly being configured to be coupled to the first sling hook, and the right upper loop assembly and left lower loop assembly configured to be coupled to the second sling hook;

at least two straps on the outer surface and positioned on the body supporting portion, at least two of the straps extending on the body supporting portion substantially to a respective left and right upper loop assembly.

2. The patient lift apparatus of claim 1, wherein the left and right upper loop assemblies each include a plurality of loops, the pluralities of loops providing a plurality of pairs of left and right upper loops that are substantially equidistant from the support surface.

3. The patient lift apparatus of claim 2, wherein the left and right lower loop assemblies each include a plurality of loops, the pluralities of loops providing a plurality of pairs of left and right lower loops that are substantially equidistant from the support surface.

4. The patient lift apparatus of claim 1, wherein the left and right lower loop assemblies each include a plurality of loops, the pluralities of loops providing a plurality of pairs of left and right lower loops that are substantially equidistant from the support surface.

5. The patient lift apparatus of claim 1, wherein at least one of the left and right upper loop assemblies is formed from a single piece of fabric coupled to the support surface.

6. The patient lift apparatus of claim 5, wherein the left and right upper loop assemblies are both formed from a single piece of fabric coupled to the support surface.

7. The patient lift apparatus of claim 1, wherein the left and right lower loop assemblies are formed from fabric coupled to the support surface.

8. The patient lift apparatus of claim 1, wherein the sling includes an outer surface opposite the support surface and at least one handle coupled to the outer surface.

9. The patient lift apparatus of claim 8, wherein the at least one handle is located substantially equidistant from the left and right upper loop assemblies.

10. The patient lift apparatus of claim 9, wherein the sling further includes at least one outer handle between the at least one handle and one of the left and right upper loop assemblies.

11. The patient lift apparatus of claim 9, wherein the sling further includes a left outer handle between the at least one handle and the left upper loop assembly and a right outer handle between the at least one handle and the right upper loop assembly.

12. The patient lift apparatus of claim 9, the at least one handle comprising a left outer handle and a right outer handle, wherein the left upper loop assembly and the left outer handle are formed from a piece of fabric coupled to the support surface and the right upper loop assembly and the right outer handle are formed from another piece of fabric coupled to the support surface.

13. The patient lift apparatus of claim 1, wherein the support surface includes an upper edge and a lower edge, and at least one flexible reinforcement member is coupled to the support surface extending from adjacent the upper edge to adjacent the lower edge.

14. The patient lift apparatus of claim 1, wherein the attachment bar has first and second laterally spaced-apart ends, and includes a first hook bracket attached to the first laterally spaced apart end and a second hook bracket attached to the second laterally spaced apart end, each of the first and second hook brackets including spaced apart sling hooks for receiving the sling assembly, and the loops of the sling assembly being configured to be coupled to separate sling hooks so that only the left and right lower loop assemblies are crossed with each other.

15. The patient lift apparatus of claim 1, wherein at least one of the left and right upper loop assemblies is formed from multiple pieces of fabric coupled to the support surface.

16. The patient lift apparatus of claim 15, wherein the left and right upper loop assemblies are both formed from multiple pieces of fabric coupled to the support surface.

17. The patient lift apparatus of claim 1, further comprising a weighing scale for determining the weight of a patient supported by the apparatus.

18. The patient lift apparatus according to claim 17, wherein the weighing scale is provided between the lifting arm and the attachment bar.

19. The patient lift apparatus according to claim 1, wherein the sling hooks and loop assemblies are color coded.

20. The patient lift apparatus according to claim 14, wherein the sling hooks and loop assemblies are color coded.

21. The patient lift apparatus as in claim 1, wherein the body supporting portion comprises a torso supporting portion coupled to a seat supporting portion, and the left and right upper loop assemblies are coupled to the torso supporting portion, and the left and right leg portions are coupled to the seat portion.

22. The patient lift apparatus of claim 1, wherein the plurality of support straps comprise at least one pair of vertical parallel straps disposed symmetrically about a vertical axis of symmetry of the sling, and configured to run parallel to the patient's spine.

23. The patient lift apparatus of claim 1, wherein the plurality of support straps comprise at least one horizontal strap disposed transverse to a vertical axis of symmetry of the sling, and configured to run transverse to the patient's spine.

24. The patient lift apparatus as in claim 22, wherein the plurality of support straps further comprises a left diagonal strap and a right diagonal strap, each diagonal strap extending substantially to the upper left loop and the upper right loop, respectively.

25. The patient lift apparatus as in claim 1, wherein the plurality of straps are coupled to the outer surface, and further comprising at least one handle formed on the plurality straps.

26. The patient lift apparatus as in claim 1, wherein the leg portion has foam padding to enhance the patient's comfort.

27. The patient lift apparatus as in claim 1, further comprising a left side handle and a right side handle of side handle, each of the left and right side handles having a first end coupled to the left and right upper loop assemblies, respectively, and a second end coupled to the first handle.

28. The patient lift apparatus as in claim 27, wherein the plurality of support straps and each of the handles and support are cooperatively configured to be superimposed on one another and each handle is coupled to a support strap.

29. The patient lift apparatus as in claim 1, further comprising a back handle coupled to the outer surface and positioned adjacent a patient's spine.

30. The patient lift apparatus as in claim 29, wherein the back handle is configured to be substantially transverse to the patient's spine.

31. A patient lift apparatus comprising:

a base;

a frame extending upwardly from the base;

a lifting arm pivotally coupled to the frame for movement of the lifting arm between a lowered position and a raised position;

an actuator coupled to the lifting arm for moving the lifting arm between the lowered position and a raised position;

a mounting bracket coupled to the lift arm by a first mounting bolt which allows rotation of the mounting bracket about a horizontal axis;

an attachment bar connected to the mounting bracket and having first and second laterally spaced apart sling hooks a second mounting bolt separate from the mounting bracket, connected to the attachment bar and positioned between the first and second sling hooks, the second mounting bolt pivotally coupled to the mounting bracket to allow rotation of the attachment bar relative to the lifting arm about a vertical axis extending through the second mounting bolt; and a sling assembly configured to be coupled to the attachment bar for holding a patient off the ground, the sling assembly including a support surface, left and right upper loop assemblies coupled to the support surface, and left and right lower loop assemblies coupled to the support surface, the left upper loop assembly and right lower loop assembly being configured to be coupled to the first sling hook and the right upper loop assembly and left lower loop assembly being configured to be coupled to the second sling hook.

32. The patient lift apparatus of claim 31, wherein the attachment bar includes first and second laterally extending arms integrally connected to the second mounting bolt.

33. The patient lift apparatus of claim 31, wherein the attachment bar first end includes a first color coding, the attachment bar second end includes a second color coding, the left upper loop assembly and right lower loop assembly include the first color coding, and the right upper loop assembly and left lower loop assembly include the second color coding.

34. The patient lift apparatus of claim 31, wherein the attachment bar includes a first hook bracket attached to the first laterally spaced apart end and a second hook bracket attached to the second laterally spaced apart end, each of the first and second hook brackets including spaced apart sling hooks for receiving the sling assembly, and the loops of the sling assembly being configured to be coupled to separate sling hooks so that only the left and right lower loop assemblies are crossed with each other.

35. The patient lift apparatus of claim 31, further comprising a scale for determining the weight of a patient supported by the apparatus.

36. The patient lift apparatus according to claim 35, wherein the scale is provided between the lifting arm and the mounting bracket.

37. The patient lift apparatus according to claim 34, wherein the sling hooks and loop assemblies are color coded.

38. A patient lift apparatus comprising:

a base;

a frame extending upwardly from the base;

a lifting arm pivotally coupled to the frame and movable between a lowered position and a raised position;

first and second laterally spaced apart sling hooks connected to the lifting arm;

a sling assembly attachable to the hooks and including
a support surface, left and right upper loop assemblies attached to the support surface,
and left and right lower loop assemblies attached to the support surface, the loop
assemblies being configured to engage the sling hooks, a left outer handle on an outer surface opposite the support surface;

a right outer handle on an outer surface opposite the support surface; and wherein, the left upper loop assembly and the left outer handle are formed from a piece of fabric coupled to the support surface and the right upper loop assembly and the right outer handle are formed from another piece of fabric coupled to the support surface.

39. A patient lift apparatus comprising:

a base;

a frame extending upwardly from the base;

a lifting arm pivotally coupled to the frame for movement of the lifting arm between a lowered position and a raised position;

an attachment bar connected to the lifting arm, the attachment bar having first and second laterally spaced apart sling hooks;

an electronic weighing scale positioned between the lifting arm and the attachment bar, and configured to weigh a patient in the lift apparatus;

a sling assembly configured to be coupled to the attachment bar to hold a patient off the ground, the sling assembly including
a body supporting portion coupled to a seat portion,
left and right leg portions coupled to the seat portion,
left and right upper loop assemblies coupled to the body supporting portion and,
left and right lower loop assemblies coupled to the left and right leg portions,
respectively, the loop assemblies configured to be coupled to the sling hooks.

40. The patient lift assembly as in claim 39, wherein the weighing scale connects the attachment bar to the lifting arm.

* * * * *